United States Patent [19]

Michel et al.

[11] Patent Number: 4,783,995

[45] Date of Patent: Nov. 15, 1988

[54] LOGGING TOOL

[75] Inventors: Donald H. Michel, Lafayette, La.; Paul A. Boatright, College Station, Tex.

[73] Assignee: Oilfield Service Corporation of America, Lafayette, La.

[21] Appl. No.: 22,676

[22] Filed: Mar. 6, 1987

[51] Int. Cl.[4] ..... E21B 47/00

[52] U.S. Cl. ..... 73/151; 166/250

[58] Field of Search ..... 73/151, 152; 166/253, 166/278, 285, 250; 250/254

[56] References Cited

U.S. PATENT DOCUMENTS

| | | | |
|---|---|---|---|
| 2,156,052 | 4/1939 | Cooper | 181/0.5 |
| 2,524,031 | 10/1950 | Arps | 255/1 |
| 4,041,780 | 8/1977 | Angehrn | 73/151 |
| 4,044,832 | 8/1977 | Richard | 166/278 |
| 4,049,055 | 9/1977 | Brown | 166/278 |
| 4,216,536 | 8/1980 | More | 367/83 |
| 4,254,479 | 3/1981 | Wiley | 367/35 |
| 4,492,865 | 1/1985 | Murphy et al. | 250/265 |
| 4,494,072 | 1/1985 | Jeter et al. | 324/347 |
| 4,529,939 | 7/1985 | Kuckes | 324/346 |
| 4,607,694 | 8/1986 | Sah | 73/151 X |

OTHER PUBLICATIONS

Marvin R. Neal, "Gravel Pack Evaluation", Sep. 1983, Journal of Petroleum Technology, pp. 1611–1616.

*Primary Examiner*—Jerry W. Myracle
*Attorney, Agent, or Firm*—Kirkland & Ellis

[57] ABSTRACT

An apparatus and method are disclosed for logging the density of a gravel pack installation in a drill hole while the gravel pack installation tool is being withdrawn from the drill hole. After the apparatus is recovered at the earth's surface, the density log is recovered by means of a dedicated surface readout module. The logged data of the density of the gravel packed zone is examined for voids in the gravel pack. If any such void is indicated from the data, remedial action can be taken promptly while the gravel pack equipment is still at the drill hole site.

26 Claims, 4 Drawing Sheets

LOGGING TOOL

BACKGROUND OF THE INVENTION

1. Field of the Invention

This invention pertains to a method and apparatus for logging the gravel pack zone of an oil/gas well immediately after it has been gravel packed. The apparatus is attached to the gravel pack service tool prior to commencing the gravel pack installation process. After completion of the gravel pack installation process, the gravel pack density is logged while the gravel pack service tool is being withdrawn from the drill hole.

2. Description of the Prior Art

Production of formation sand is a frequent problem of oil/gas wells. When sand production is significant, it may fill the well, plug the perforations in the production screen, fill the gas/oil separators and in some cases cut through the pipes and valves. In some cases sand production may weaken the formation, leading to formation and casing collapse and loss of the well. The costs of remedial action are in many cases enormous.

The principal methods of controlling sand production include limiting the production rates, consolidating the formation by chemical means and installing a gravel pack between the formation and the screening device in the well bore. With the gravel pack method, the gravel pack acts as a filter and holds the formation sand out of the well bore while permitting maximum gas or oil production. Such a gravel pack method and apparatus is disclosed in U.S. Pat. No. 4,044,832, issued Aug. 30, 1977 to Richard, et al. for "Concentric Gravel Pack With Crossover Tool and Method of Gravel Packing."

Voids may occur in the gravel pack during its installation. These voids usually are not evident during the installation process, but rather, become evident only after the gravel pack installation process is completed, and sometimes only after the well is in production. Voids in the gravel pack permit the flow of sand from the formation into the well bore during production. These may lead to early failure of the well requiring expensive remedial workover. Therefore, it is desirable to evaluate the installed gravel pack and to detect any voids soon after installation and before production.

A method of logging the density of the material surrounding well holes with a radioactive source and a detector is described in U.S. Pat. No. 4,492,865, issued Jan. 8, 1985, to Murphy, et al. for "Borehole Influx Detector and Method". This method is adaptable for logging gravel packs. The radioactive source emits gamma radiation, which impacts the material surrounding the well bore. The effects of the emissions impacting the volume of material between the logging tool and the formation are measured by the detector. By suitable choice of source and detector, the logging tool is made responsive to the density of the material in the volume surrounding the tool. Because the well bore fluids in general have less density than the materials used in a gravel pack, a void in the gravel pack is revealed by an area of reduced density.

Current practice is to remove the gravel pack service tool equipment from the well bore after completion of the gravel pack installation. A density logging tool is then lowered on an electric wireline and a density log is run of the interval of the well containing the gravel pack. See, for example, U.S. Pat. No. 2,156,052, issued Apr. 25, 1939 to Cooper for "Logging Device." Because different equipment is used for the installation of the gravel pack and for logging the gravel pack density, there is a delay between the gravel pack installation and the subsequent logging while the gravel pack equipment is removed and the logging tool is lowered into position. The delay between the gravel pack installation and logging run means additional rig time and service company costs. Moreover, if a void in the gravel pack installation is indicated by the data obtained from the logging run, then the gravel pack service tool equipment must be re-inserted into the well bore for remedial action. In some cases, the gravel pack service tool equipment may have been removed from the well site for use at another well site, thereby resulting in additional delays and costs before the void is corrected.

It is desirable to reduce such costs and delays by detecting any voids immediately after completion of the gravel pack installation. While methods for downhole logging are known in the art (see U.S. Pat. No. 4,529,939, issued July 16, 1985 to Kuckes for "System Located in Drill String for Well Logging While Drilling"; U.S. Pat. No. 4,492,865, issued Jan. 8, 1985 to Murphy, et al for "Borehole Influx Detector and Method"; and U.S. Pat. No. 4,041,780, issued Aug. 16, 1977 to Angehrn for "Method and Apparatus for Logging Earth Boreholes"), these methods, unlike the present invention, do not disclose the detection of gravel pack voids immediately following gravel pack installation as the gravel pack service tool is withdrawn. The present invention provides such capability.

In brief, the density logging tool of the present invention is connected to the lower end of the gravel pack service tool equipment before it is lowered into the well bore for gravel pack installation. The logging tool, which in the preferred embodiment does not require any electric wirelines, remains inactive until the gravel pack installation is completed. As the gravel pack service tool equipment begins to be removed from the gravel pack assembly and well bore following completion of the gravel pack installation, the density logging tool is automatically activated and the gravel pack density is logged as the logging tool is withdrawn along with the gravel pack tool. The logged density data is stored digitally in the logging tool. The present invention also includes capability to limit significant power consumption to the periods when gravel pack density data is taken.

The data collected by the density logging tool is transferred from the logging tool to a surface module after the logging tool is retrieved at the surface. Then, in the preferred embodiment, the digital data is stored for archival purposes on a cassette recorder in the surface module, and a strip chart recording is made of the density log data for immediate analysis. If the analysis of the log indicates that voids are present in the gravel pack, then remedial action can be initiated immediately. The principles of operation of such a tool and the preferred embodiment are described below. In an alternative embodiment, the digital data can be transmitted by appropriate telemetry or other transmission means to the surface for evaluation in real time, or after a time delay, but before the density logging tool is retrieved at the surface.

BRIEF DESCRIPTION OF THE DRAWINGS

The objects and features of the present invention will become more apparent from a consideration of the following detailed description and the drawing in which.

DESCRIPTION OF THE PREFERRED EMBODIMENT

Figure 1:
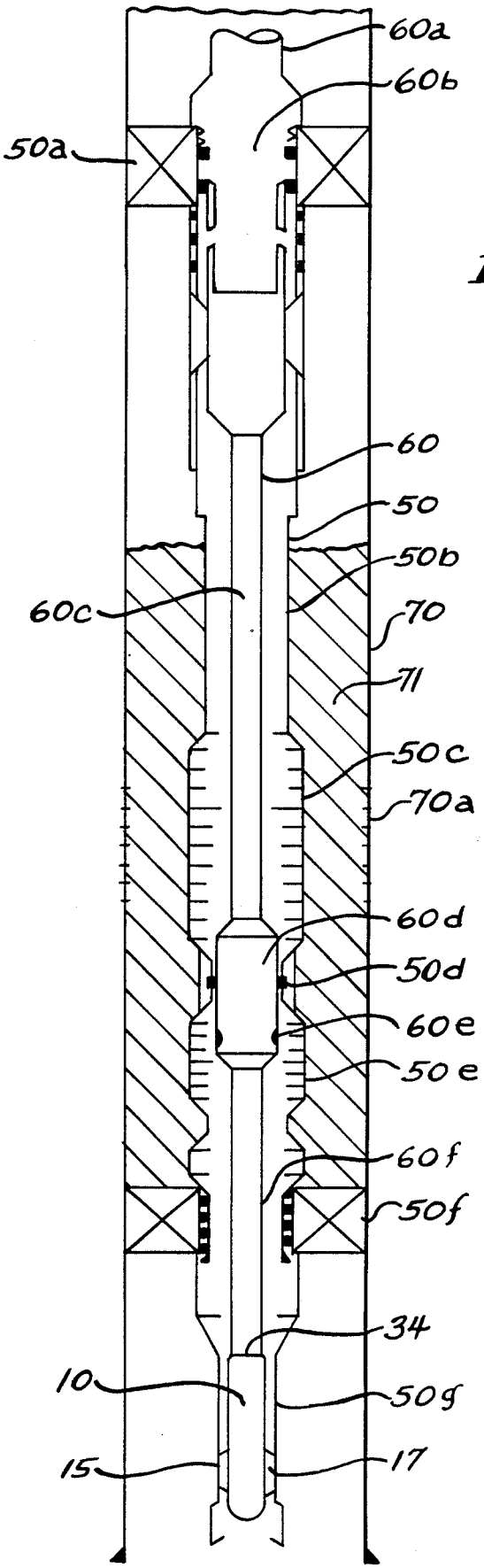
FIG. 1 is a schematic elevation view of the logging tool of the present invention attached to the lower end of a gravel pack service tool apparatus in a well bore.

FIG. 1 illustrates logging tool 10 of the present invention connected to the lower end of gravel pack service tool equipment 60, which is inside gravel pack assembly 50, which in turn is inside well bore 70. Gravel pack service tool equipment 60 and gravel pack assembly 50 are of a type known in the art, such as that described in U.S. Pat. No. 4,044,832, issued Aug. 30, 1977 to Richard, et al. for "Concentric Gravel Pack With Crossover Tool and Method of Gravel Packing."

As illustrated in FIG. 1, gravel pack service tool equipment 60 is generally comprised of main pipe 60*a;* hydraulic setting cross-over tool 60*b;* wash pipe 60*c;* and polished stinger or seals 60*d* with ports 60*e*. Gravel pack assembly 50 is generally comprised of gravel pack production packer 50*a;* blank pipe 50*b;* production screen 50*c;* O-ring or seal sub 50*d;* tell-tale screen 50*e;* wireline set sumper tag packer 50*f;* and restricted inside diameter (ID) pipe 50*g*. Logging tool 10 of the present invention is connected to gravel pack service tool equipment 60 via wash pipe extension 60*f* and sub 34 (sub 34 is more fully described below). Bow strings 15 and 17, which serve as the activating mechanism for logging tool 10 (as more fully described below), are compressed when logging tool 10 is inside restricted ID pipe 50*g*.

The placement of a gravel pack in a well bore (such as gravel pack 71 in well bore 70 of FIG. 1) via a gravel pack service tool equipment and a gravel pack assembly (such as gravel pack service tool equipment 60 and gravel pack assembly 50 of FIG. 1) is known in the art and will not be further described. The extraction of oil from the completed well (through perforations 70*a,* gravel pack 71 and production screen 50*c* and up through blank pipe 50*b*) also is known in the art and will not be further described.

Figure 2:
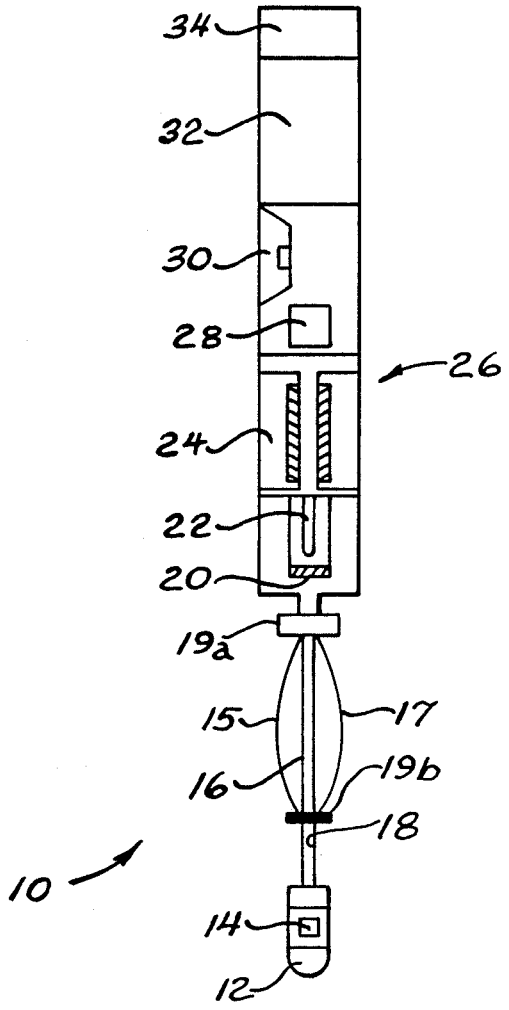
FIG. 2 is a schematic elevation view of the mechanical portions of the logging tool of the present invention.

Referring now to FIG. 2, logging tool 10 of the present invention (connected to wash pipe extension 60*f* via sub 34 in FIG. 1) includes bullplug 12 that protects the lower end of logging tool 10 and guides logging tool 10 through any restricted sections of pipe (not shown in FIG. 2) as logging tool 10 is lowered into the well bore (not shown in FIG. 2). Logging tool 10 also includes a conventional radioactive source 14 that emits gamma radiation for measuring the bulk density of the material surrounding logging tool 10. Centralizer 16 (comprising bow springs 15 and 17, mounting ring 19*a* and slider 19*b*) functions both to maintain logging tool 10 coaxially in the center of the pipe (not shown in FIG. 2) and to operate centralizer-controlled switch 18, which activates logging tool 10 as more fully described below. Radiation detector 22, which in the preferred embodiment is comprised of a conventional geiger tube, measures the back scatter of radiation emitted from radioactive source 14 that is reflected to radiation detector 22 by the material surrounding logging tool 10. Shield 20 prevents a direct path between radioactive source 14 and radiation detector 22. This results in the radiation received by radiation detector 22 being composed primarily of radiation reflected from the volume of material surrounding logging tool 10.

Electronic compartment 26 is comprised of radiation detector 22, controller and data storage means 24 and power source 28. Connector 30 is provided to connect the surface module (not shown in FIG. 2) to logging tool 10 after retrieval at the earth's surface, without requiring the disassembly of logging tool 10 (the surface module of the present invention is more fully described in connection with FIG. 4).

It is desirable to ascertain both the existence of any voids in the gravel pack installation and also the location of any such voids. For this purpose casing collar locator (CCL) 32 is provided. Casing collar locators, such as CCL 32, are known in the art, an example being No. 713010-011 manufactured by SIE Co. of Ft. Worth, Tex., the manufacturer's specifications and instruction manual for which are hereby incorporated by reference. CCL 32 senses the connection between joints of pipe in the well bore when CCL 32 comes into proximity of such joints, and conveys this information to controller and data storage means 24 as more fully described below. Because the number of joints of pipe and the length of each pipe are carefully recorded during installation of the pipe, CCL 32 provides a convenient and accurate method of pinpointing the location of any void in the gravel pack installation by reference to pipe joint position.

Logging tool 10 is attached to the lower end of gravel pack service tool equipment 60 (see FIG. 1) by means of sub 34. As is known in the art, subs such as sub 34 of the present invention are used to connect two threaded objects together. Both ends of sub 34 are threaded, with the threads on the upper end matching the threads on wash pipe extension 60*f* of gravel pack service tool equipment 60 (see FIG. 1), and the threads on the lower end matching the threads on logging tool 10. Thus, sub 34 screws onto wash pipe extension 60*f,* and logging tool 10 screws onto sub 34, thereby connecting logging tool 10 to wash pipe extension 60*f.*

Figure 3:
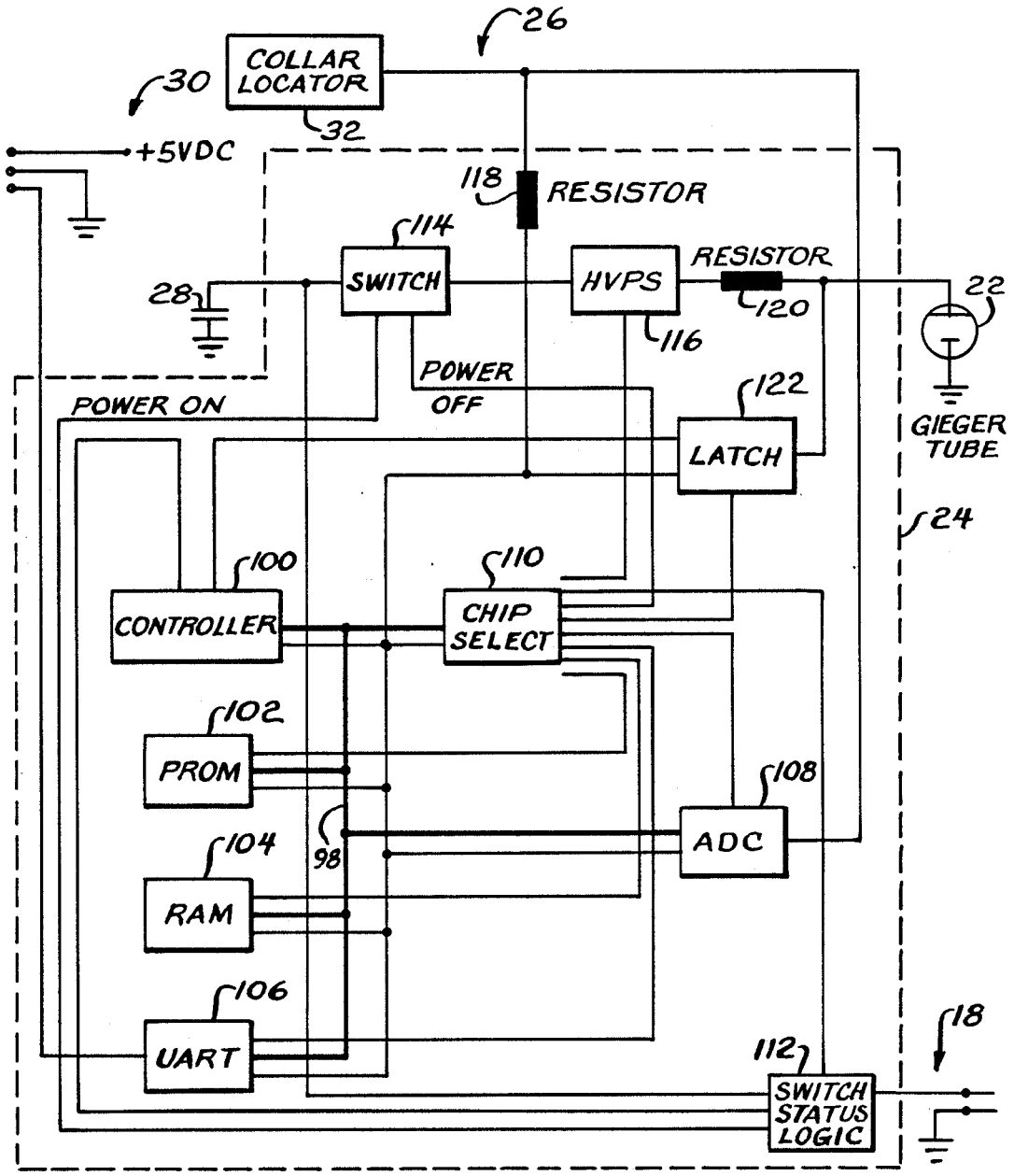
FIG. 3 is a functional block diagram of the electronic assemblies within the logging tool of the present invention.

Referring now to FIG. 3, the contents of electronic compartment 26 and other components will be described in greater detail. Controller 100, which, in the preferred embodiment, is a suitable microprocessor, directs the operation of the various elements of logging tool 10. By executing an appropriate sequence of instructions that is stored as firmware in PROM (programmable read only memory) 102, controller 100 counts the number of gamma rays impacting the geiger tube of radiation detector 22 per unit of time, monitors the output of ADC (analog-to-digital converter) 108 to sense the location of pipe joints that are detected by CCL 32, stores the geiger tube counts per unit of time and CCL information in RAM (random access memory) 104, communicates with the surface module (not shown in FIG. 3) by means of UART (universal asynchronous receiver/transmitter) 106, de-activates power switch 114 through chip select circuit 110 to disconnect power source 28 from the various components of logging tool 10 at the appropriate time (as more fully described below), and senses the state of centralizer controlled switch 18 by means of switch status logic 112. Switch status logic 112 is a low-power-consuming circuit that senses the state of switch 18 (i.e., open or closed). In the preferred embodiment, switch status logic 112 also contains conventional timing circuitry to generate an output only when switch 18 has been closed for selected intervals of time. Such timing circuitry and such uses of microprocessors as in controller 100 are known in the art and are discussed in such publications as the National Semiconductor CMOS Data Book, the contents of which are hereby incorporated by reference.

Although in the preferred embodiment the required sequence of instructions for directing the operation of controller 100 are stored as firmware in PROM 102, such instructions could be stored as software in any appropriate type of memory for access by controller 100. In the preferred embodiment, the data collected (i.e., the geiger tube counts per unit of time and the CCL information) are stored in RAM 104. In other embodiments, the data collected are stored in other suitable means, such as electro-mechanical recorders or magnetic tape recorders.

UART 106 provides a means of transferring the logged gravel pack density data from logging tool 10 to the surface readout module (not shown in FIG. 3), as more fully described below. UART 106 is a standard, commercially available part, such as National Semiconductor Part Number NSC858. The techniques for use of such a device are known in the art and are described in such publications as the National Semiconductor CMOS Data Book referenced above. In an alternative embodiment, RAM 104 is arranged to facilitate its being physically removed from logging tool 10 at the earth's surface and installed in a conventional readout device (not shown), thereby enabling retrieval of the logged data without utilization of UART 106. In yet another alternative embodiment, connector 30 is provided with sufficient conductors to permit the logged data to be read out by a technique known in the art as DMA (direct memory access) from RAM 104.

As previously described, CCL 32 detects the connections or joints between sections of pipe (see FIG. 2). As is known in the art, this is accomplished by measuring the change in magnetic flux as a magnet (not explicitly shown) contained within CCL 32 passes a pipe joint. The discontinuity in the mass of metal of the pipe at the connection point within each joint is sensed as a change in magnetic flux by CCL 32. This change is amplified by a circuit internal to CCL 32 (not explicitly shown) that reflects this change in flux as a significant variation in the electric current drain of CCL 32 from the normal quiescent value. This variation in current creates a corresponding variation in the voltage drop across current limiting resistor 118. This resulting variation in voltage as CCL 32 passes a pipe connection point is monitored by ADC 108.

ADC 108 converts the analog voltage variation produced by CCL 32 to a digital form that can be interpreted by controller 100. Controller 100 samples the output of ADC 108 at suitable, frequent intervals. Upon detecting a voltage variation characteristic of a pipe joint, controller 100 stores the time of the occurrence of passing the pipe joint in RAM 104.

The electronic components that are in frequent and direct communications with controller 100 share a common communication bus 98. Controller 100 communicates with only one device at a time, in a sequence determined by the program stored in PROM 102. Chip select circuit 110, under direction of controller 100, activates each of the components of circuit 90 as needed, leaving the others inactive. In this way common communication bus 98 is used by controller 100 to communicate with only one component at a time. Such common-bus communication techniques are known in the art.

Power source 28 provides electrical power to the various components of logging tool 10 via switch 114. To conserve power, switch 114 is used to selectively power the various components of logging tool 10 at appropriate times as described below. RAM 104 and switch status logic 112 are in a low power, standby mode while monitoring progress of the gravel pack installation. The power to the remaining power-consuming elements of logging tool 10 are turned off completely except when a logging run is in process. The algorithm for achieving this is described in greater detail below.

Power from the power source 28 is input to HVPS (high voltage power supply) 116 at the appropriate times via switch 114. HVPS 116 is activated under direction of controller 100 via chip select circuit 110 after application of power to HVPS 116 from switch 114. HVPS 116 converts the relatively low DC voltage of power source 28 to the relatively high voltage (e.g., 1000 VDC) required by the geiger tube of radiation detector 22 in a conventional manner. Because the geiger tube of radiation detector 22 operates on the principle that gamma rays impacting the tube cause the gasses contained within the tube to partially ionize and become highly electrically conductive, resistor 120 is provided as a current limiting resistor. The voltage drop across the geiger tube of radiation detector 22 is input to latch 122.

The geiger tube of radiation detector 22 becomes conductive when it is impacted by gamma rays thereby resulting in a decrease of the voltage drop across the geiger tube. When this voltage decrease is sufficiently great, latch 122 goes to the ON state. Controller 100 senses this change of state of latch 122, registers the count by incrementing an internal register, and resets latch 122 to the OFF state. This handshake operation is used because the time duration of the voltage variation due to gamma rays impacting a geiger tube is extremely short and the occurrence of an impact is a random event. The handshake operation prevents a gamma count from being missed if the gamma ray impact occurs while controller 100 is performing other activities.

In an alternative embodiment, a conventional counter is utilized to obtain and record the number of counts from the geiger tube of radiation detector 22. In this embodiment, the counter would increment in response to pulses in the voltage drop across geiger tube 22. At appropriate intervals, controller 100 would read and reset the output of the counter, accumulating the number of counts in the internal registers of controller 100. Examples of counters that are suitable for the present invention include: National Semiconductor's MM74HC590 or MM74HCT590. Numerous equivalent devices that are suitable for the present invention are readily available for use in alternative embodiments.

In the design of downhole logging tools generally, compromise is required among the capacity, size and cost of the tool. In the present invention the capacities of the power source and data storage must be considered and these resources carefully conserved by allowing operation of logging tool 10 only when the gravel pack installation is complete and a logging run is desired. For example, the gravel pack apparatus and logging tool typically will be in position in the well for several hours while the gravel pack is being installed. Also, delays while positioning the gravel pack equipment in the well are common. No useful density information is available during these times. Centralizer controlled switch 18 and switch status logic 112 conserve power by allowing gravel pack density data collection, and therefore significant power consumption, only when the gravel pack installation is complete and the tool string is being withdrawn. These considerations are not as significant if, as in alternative embodiments, power is transmitted between the logging tool and the surface while the logging tool is in the drill hole collecting data.

As previously described, logging tool 10 is positioned in pipe 50*g* of reduced inside diameter (ID) during gravel pack installation (see FIG. 1). During this time bow springs 15 and 17 on centralizer 16 (see FIG. 2) are compressed (see FIG. 1). This action serves to close centralizer controlled switch 18 as described below.

Centralizer-controlled switch 18 is a conventional magnetically actuated reed switch. Referring again to FIG. 2, centralizer 16 consists of bow springs 15 and 17 fixed at the upper end by mounting ring 19*a*, with the opposite ends of bow springs 15 and 17 attached to slider 19*b*. Slider 19*b* is a collar or ring like piece that is free to slide on the body of centralizer 16. As bow springs 15 and 17 of centralizer 16 are compressed, the ends of bow springs 15 and 17 attached to slider 19*b* cause slider 19*b* to move downward toward switch 18, which, in the preferred embodiment, is internal to the body of centralizer 16. A permanent magnet (not explicitly shown) internal to slider 19*b* moves into and out of proximity of magnetic reed switch 18 as bow springs 15 and 17 are compressed and expanded respectively, thereby closing and opening switch 18. Centralizer-controlled switch 18 therefore can be located internal to the tool body, thereby avoiding the necessity of and problems associated with a pressure resistant switch.

The closure of switch 18 in response to centralizer 16 is only one factor used by controller 100 to determine the operating status of logging tool 10. This is because of the presence of another restricted ID section of pipe at O-ring or seal sub 50*d* (see FIG. 1) just above restricted ID pipe 50*g*. In general, other restricted ID points also may exist between the point of entry at the earth's surface and these specific points of restricted ID. Other characteristics of the operating environment also are taken into account in controlling the status of logging tool 10 to avoid activating the logging tool at an inappropriate time. For example, while a gravel pack is being installed, logging tool 10 will be positioned in the restricted ID section of pipe 50*g* for a matter of hours, while the time intervals during which logging tool 10 is positioned in the other points of restricted ID (such as at O-ring or seal sub 50*d*) typically will be on the order of minutes.

Using the actual state (i.e., open or closed) of switch 18 and the duration of closure, an algorithm is executed by controller 100 that assures that logging tool 10 is in an active state when and only when gravel pack density data is to be logged.

The activation of the various components of logging tool 10 in response to closures of centralizer controlled switch 18 will now be described. At the earth's surface, logging tool 10 is initially in the Inactive State. In the Inactive State, RAM 104 and switch status logic 112 of FIG. 3 are the only circuits consuming electrical power. Controller 100 does not have power applied, and is therefore inactive. In this state, RAM 104 is in a stand-by mode and consumes only the minimal power required to retain the RAM memory contents. Switch status logic 112 is a low power circuit that consumes only microwatts of electrical power. In the preferred embodiment, a small power source, such as a conventional battery (not shown), independent from power source 28 provides the stand-by mode power for RAM 104. In other embodiments, stand-by mode power for RAM 104 is obtained from power source 28 in a conventional manner.

During initial positioning of logging tool 10 in the well bore, closures of centralizer controlled switch 18 (due to logging tool 10 passing through sections of restricted ID pipe) of less than one hour are ignored (i.e., in the Inactive State, switch status logic 112 does not respond to closures of switch 18 of less than one hour duration). Switch status logic 112 responds only to closure intervals of switch 18 of greater than one hour. After sensing a closure of switch 18 of at least one hour, logging tool 10 switches to the Armed State. In the Armed State, the internal state of switch status logic 112 changes so that switch status logic 112 will generate an output upon opening of switch 18 (i.e., in the Armed State, switch 18 has been closed for one hour and switch status logic 112 will generate an output when switch 18 is subsequently opened).

In the Armed State all major electrical power consuming components remain off. Switch status logic 112 remains active and RAM 104 remains in stand-by mode. Upon the next opening of switch 18, switch status logic 112 generates an output that causes switch 114 to supply power to the remaining power consuming elements of logging tool 10 as shown in FIG. 3. In the preferred embodiment, HVPS 116 is inactive and consumes only minimal power until HVPS 116 receives an appropriate command from controller 100 via chip select circuit 110. Upon application of power, controller 100, under software control and in response to this output from switch status logic 112, activates HVPS 116 via chip select circuit 110 and thereby causes logging tool 10 to advance to the Active State, and logging and collection of data commence. All devices are electrically powered in the Active State. UART 106 is placed in a low-power mode by receipt of an appropriate instruction from controller 100. The density of the installed gravel pack is logged by a deliberate withdrawing of logging tool 10 from the well bore when logging tool 10 is in the Active State.

While in the Active State, switch status logic 112 continues to monitor switch 18. Switch status logic 112 in turn is monitored by controller 100. If switch 18 subsequently is closed by bow springs 15 and 17 of centralizer 16 (by insertion of logging tool 10 into a restricted ID section of pipe) and remains closed, switch status logic 112 does not initially generate an output, and logging continues after switch 18 is closed. If, however, switch 18 continuously remains closed for ten minutes, switch status logic 112 generates an output that is received by controller 100, and logging tool 10 advances to the Conditional Reset State. It should be apparent that if switch 18 re-opens before having been closed for ten minutes while logging tool 10 is in the Active State, logging tool 10 remains in the Active State and logging continues unabated.

In the Conditional Reset State, high voltage power supply (HVPS) 116 is shut off by controller 100 (via chip select circuit 110) and logging stops. Under software control, ADC 108 is placed in a low power mode by controller 110, which causes ADC 108 to maintain its current state without further digital conversion of the analog signal at its input. Power continues to be applied to the remaining circuit elements of FIG. 3. (UART 106 remains in a low-power mode). Controller 100 also stays active to monitor the status of switch 18 via switch status logic 112. If switch 18 opens within one hour, then controller 100 directs that the HVPS 116 and the remaining components are turned on and logging of gravel pack density data resumes. If switch 18 remains closed for longer than one hour, then logging tool 10 advances to the Reset State.

In the Reset State, the power to all components except status switch logic 112 and RAM 104 is off, and all logging activities continues to be halted. RAM 104 is in the stand-by mode in the Reset State. Additionally in the Reset State, the pointer, which is maintained by controller 100 to select the next location in RAM 104 memory in which to store data, is reset to its starting location. Subsequent logging, which in the preferred embodiment begins upon the next opening of switch 18, will start using the first memory location of RAM 104, thereby writing over any previously logged data.

Thus, switch 18 may close any number of times while logging tool 10 is in the Inactive State with no effect so long as switch 18 does not remain closed for longer than one hour. Logging tool 10 may remain in the Armed State indefinitely. In the Active State, switch 18 may be closed any number of times without loss of information so long as switch 18 does not remain closed for longer than one hour. If switch 18 remains closed for longer than one hour, the logging tool would switch first to the Conditional Reset State (after ten minutes) and then to the Reset State (after an additional fifty minutes), and any previously logged data would be lost.

The various states of the preferred embodiment of the present invention are summarized in TABLE 1.

TABLE 1

| | LOG/PAC STATE DIAGRAM ACTIVE/INACTIVE/LOW POWER | | | | | |
|---|---|---|---|---|---|---|
| COMPONENT | INACTIVE | ARMED | ACTIVE | CONDITIONAL RESET | RESET | COMMUNICATION WITH SURFACE MODULE |
| CONTROLLER 100 | OFF | OFF | ACTIVE | ACTIVE | OFF | ACTIVE |
| PROM 104 | OFF | OFF | ACTIVE | ACTIVE | OFF | ACTIVE |
| RAM 104 | LOW POWER | LOW POWER | ACTIVE | ACTIVE | LOW POWER | ACTIVE |
| UART 106 | OFF | OFF | LOW POWER | LOW POWER | OFF | ACTIVE |
| CHIP SELECT 10 | OFF | OFF | ACTIVE | ACTIVE | OFF | ACTIVE |
| ADC 108 | OFF | OFF | ACTIVE | LOW POWER | OFF | ACTIVE |
| SWITCH STATUS LOGIC 112 | ACTIVE | ACTIVE | ACTIVE | ACTIVE | ACTIVE | ACTIVE |
| LATCH 122 | OFF | OFF | ACTIVE | ACTIVE | OFF | ACTIVE |
| CCL 32 | OFF | OFF | ACTIVE | ACTIVE | OFF | ACTIVE |
| HVPS 116 | OFF | OFF | ACTIVE | OFF | OFF | ACTIVE |

As is apparent to one skilled in the art, the one hour and the ten minute intervals described above may be adjusted to accommodate various operating practices without violating the intent and spirit of the present invention. In alternative embodiments, other suitable intervals are utilized.

The method described above permits considerable flexibility for the crew operating gravel pack service tool equipment 60 and gravel pack assembly 50 during the initial positioning of logging tool 10 in the well bore. Additionally, it allows the logging run to be aborted and restarted without removing logging tool 10 from the well bore. Yet, the conditions for abort are not onerous and should present no operational impediment to the operating crew.

Figure 4:
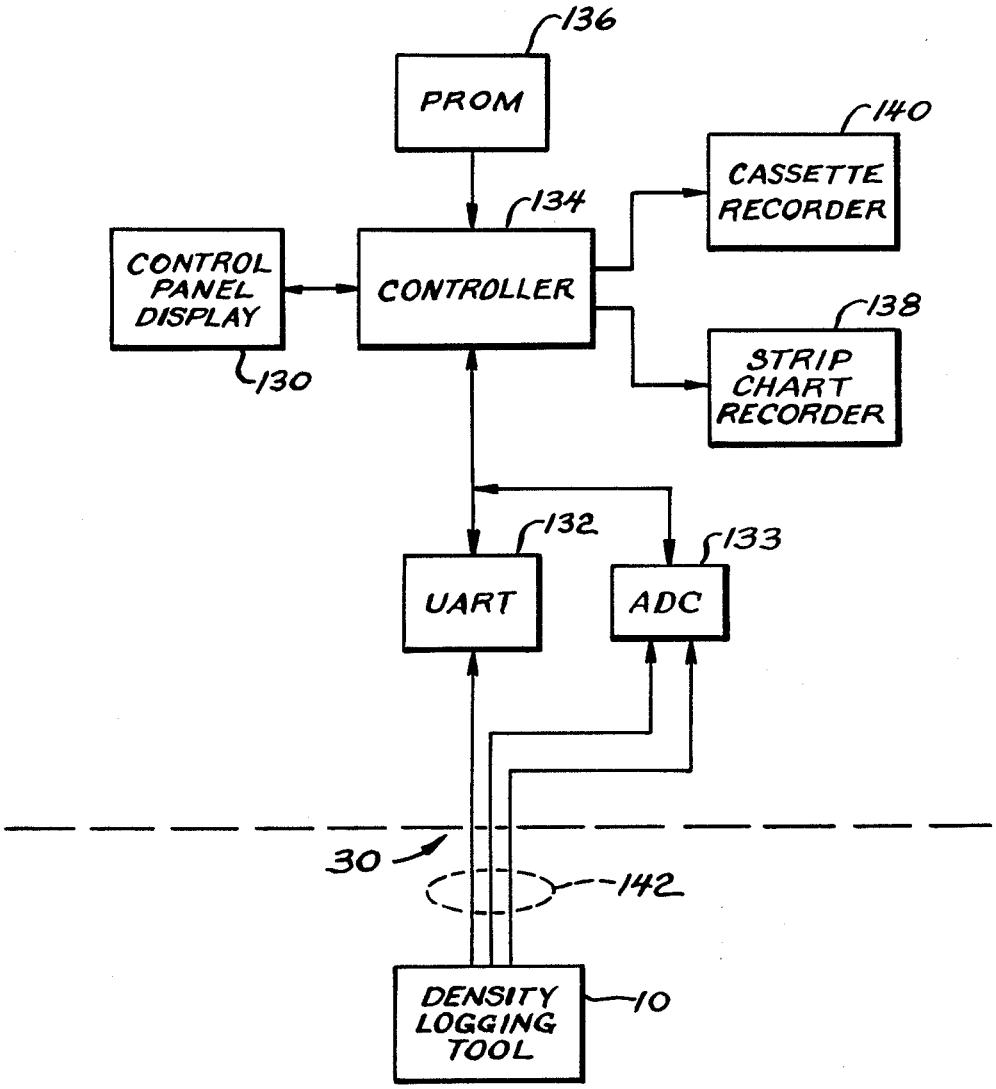
FIG. 4 is a functional block diagram of the surface readout module of the present invention.

Referring again to FIG. 3, connector 30 provides a means for connecting logging tool 10 to a surface readout module (such as shown in FIG. 4). A portion of the firmware stored in PROM 102 is dedicated to routines that enable controller 100 to communicate with the surface readout module via UART 106. Such communication routines and uses of UARTs are well known in the art and will not be further described.

Referring now to FIG. 4, the surface module of the present invention will be described. In the preferred embodiment, the surface module is a dedicated portable instrument specifically designed for extracting the logging data from logging tool 10. Its functions are to: extract data from RAM 104 of logging tool 10; store the data from RAM 104 of logging tool 10 on microcassette recorder 140 for archival purposes; plot a recording of data obtained from RAM 104 of logging tool 10 on strip chart recorder 138 for analysis and interpretation; and provide a means for evaluating proper functioning of logging tool 10.

Still referring to FIG. 4, logging tool 10 is connected to the surface module by connector 30, which includes multiconductor cable 142. Primary communication with logging tool 10 is by means of UART 132. UART 132 is identical in function to UART 106 previously described in connection with FIG. 3. Additional conductors from power source 28 are connected to ADC 133.

UART 106 of FIG. 3 and UART 132 of FIG. 4 are used to transfer data from RAM 104 of logging tool 10 to the surface module, and also to transfer instructions from the surface module to logging tool 10. These instructions are used to exercise logging tool 10 and verify its operation on the earth's surface during preparation for a logging run. These instructions are issued at the command of an operator via control panel display 130 in a conventional manner. Microcassette recorder 140 is provided to generate an archival record of the logging run data. Strip chart recorder 138 is provided so that a hard copy print out of the log can be produced at the well site for immediate operator analysis and interpretation.

All of the above described functions are directly controlled by controller 134 under direction of the operator. Controller 134 is similar in function to controller 100 of logging tool 10, and similarly can be a suitable microprocessor. The use of a microprocessor to perform such functions is known in the art and discussed in such publications as the National Semiconductor CMOS Data Book referenced above. The operator interacts with controller 134 via control panel display 130. Programs for performing each of the functions of controller 134 (in response to instructions from UART 132 and commands from control panel display 130) are contained in firmware stored in PROM 136.

In the preferred embodiment, additional conductors are provided in connector 30 for monitoring the status of power source 28 of logging tool 10. These conductors are connected to ADC 133 of FIG. 4, where the voltage level of power source 28 is monitored via control panel display 130 and controller 134 to determine if sufficient power remains in power source 28 for completion of a logging run. If the voltage level of power source 28 is determined to be below a predetermined minimum value, an indication is given to the operator via control panel display 130. A new power source 28 may then be installed in logging tool 10.

In other embodiments, data is collected after the gravel pack installation is started but before the installation is completed by use of appropriate means to transmit the logged data to the earth's surface.

As is apparent to one skilled in the art, the present invention is adaptable for analyzing properties other than density for materials other than a gravel pack when such materials are located inside a narrow channel such as a well bore.

While the preferred embodiment of the invention has been illustrated and described, it is to be understood that the invention is not limited to the precise construction herein disclosed and the right is reserved to all changes and modifications coming within the scope of the invention as defined in the appended claims.

I claim:

1. A method for evaluating the density of the material surrounding a drill hole in the earth's surface comprising the steps of:

a. attaching a logging device to a material installation tool for installing material into the area surrounding the dril hole;
b. initiating a material installation process;
c. obtaining a density log of the installed material as the material installation tool is being moved through the drill hole; and
d. evaluating the density log of the installed material.

2. The method of claim 1 further comprising the steps of:

a. sensing the status of the material installation process; and
b. activating the logging device based upon the status of the material installation process wherein the logging device logs the density log of the installed material surrounding the drill hole in the proximity of the logging device.

3. The method of claim 2 wherein the logging device is activated upon sensing the status of the material installation process to be that the material installation process has been completed.

4. The method of claims 2 or 3 wherein the logging device consumes substantial electrical power only when the logging device is logging the density log of the installed material surrounding the drill hole in the proximity of the logging device.

5. The method of claims 1 or 2 wherein the step of evaluating the density log of the installed material further comprises the step of displaying a representation of the density log of the installed material.

6. The method of claims 1 or 2 wherein the step of evaluating the density log of the installed material further comprises the steps of:

a. connecting the logging device to a display device at the surface; and
b. transmitting the density log of the installed material from the logging device to the display device.

7. The method of claims 1 or 2 further comprising the step of transmitting the density log of the installed material to a display device at the surface while the density log of the installed material is being logged.

8. The method of claims 1 or 2 further comprising the step of transmitting the density log of the installed material to a storage device at the surface while the density log of the installed material is being logged.

9. The method of claim 1 wherein the drill hole has restricted-inside-diameter portions and wherein the logging device is positioned in one of the restricted-inside-diameter portions of the drill hole during at least a portion of the material installation process and further comprising the steps of:

a. sensing whether or not the logging device is inside a restricted-inside-diameter portion of the drill hole;
b. placing the logging device in an armed state upon sensing that the logging device has been inside a restricted-inside-portion of the drill hole for at least a first preselected interval of time, wherein the armed state comprises readying the logging device so that the logging device is responsive to a sensing of the condition of the logging device being not within a restricted-inside-diameter portion of the drill hole.

10. The method of claim 9 further comprising the step of placing the logging device in an active state upon sensing that the logging device is not inside a restricted-inside-diameter portion of the drill hole while the logging device is in the armed state, wherein the active state comprises selectively applying electrical power to the logging device such that the logging device is logging the density log of the installed material.

11. The method of claim 10 further comprising the step of placing the logging device in a conditional reset state upon sensing that the logging device is inside a restricted-inside-diameter portion of the drill hole for at least a second preselected interval of time while the logging device is in the active state, wherein the conditional reset state comprises selectively applying electrical power to the logging device such that the logging device is not logging the density log of the installed material, but retains any density log of the installed material previously logged.

12. The method of claim 11 further comprising the step of placing the logging device in the active state upon sensing that the logging device is not inside a restricted-inside-diameter portion of the drill hole within less than a third preselected interval of time after the logging device enters the conditional reset state, and placing the logging device in a reset state upon sensing that the logging device is inside a restricted-inside-diameter portion of the drill hole continuously for at least the preselected third interval of time after the logging device enters the conditional reset state, wherein the reset state comprises selectively applying electrical power to the logging device such that the logging device is not logging the density log of the installed material and does not retain any density log of the installed material previously logged.

13. The method of claim 12 further comprising the step of placing the logging device in the active state upon sensing that the logging device is not inside a restricted-inside-diameter portion of the drill hole while the logging device is in the reset state.

14. An apparatus for evaluating the density of the material surrounding a drill hole in the earth's surface comprising:

a. a material installation tool for installing material into the area surrounding the drill hole; and b. logging means attached to said material installation tool for logging a density log of the installed material surrounding the drill hole while said material installation tool is being moved through the drill hole.

15. The apparatus of claim 14 further comprising means for activating said logging means when said material installation tool begins to be withdrawn from the drill hole.

16. The apparatus of claim 15 wherein said means for activating said logging means comprises:

a. sensing means responsive to whether said logging means is inside a restricted-inside-diameter portion of the drill hole; and b. power switching means responsive to said sensing means, wherein said power switching means selectively applies power to said logging means to control the operation of said logging means.

17. The apparatus of claim 16 wherein said power switching means supplies full electrical power to said logging means only when said logging means is logging the density log of the installed material surrounding the drill hole in the proximity of said logging means.

18. The apparatus of claims 14, 15, 16 or 17 further comprising surface readout module means connectable to said logging means wherein said surface readout module means comprises:

a. data receiving means for receiving the density log of the installed material from said logging means;

b. storage means for storing the received density log of the installed material; and c. display means for displaying the received density log of the installed material.

19. The apparatus of claims 14, 15, 16 or 17 further comprising:

a. transmitting means for transmitting the density log of the installed material to the surface of the drill hole; and b. surface display means for receiving from the transmitting means the density log of the installed material and displaying the density log of the installed material.

20. The apparatus of claims 14, 15, 16 or 17 further comprising:

a. transmitting means for transmitting the density log of the installed material to the surface of the drill hole; and b. surface storage means for receiving from the transmitting means the density log of the installed material and storing the density log of the installed material.

21. The apparatus of claim 14 wherein the drill hole has restricted-inside-diameter portions and wherein said logging means is positioned in one of the restricted-inside-diameter portions of the drill hole during at least a portion of the time when said material installation tool is installing material into the area surrounding the drill hole and further comprising:

a. sensing means responsive to whether said logging means is inside a restricted-inside-diameter portion of the drill hole; and b. power switching means responsive to said sensing means, wherein said power switching means selectively applies power to said logging means to control the operation of said logging means.

22. The apparatus of claim 21 wherein said power switching means places said logging means in an armed state when said sensing means senses that said logging means has been inside a restricted-inside-diameter portion of the drill hole for at least a first preselected interval of time, wherein in the armed state said power switching means readies said logging means such that said logging means is responsive to a sensing of the condition of said logging means being not within a restricted-inside-diameter portion of the drill hole.

23. The apparatus of claim 22 wherein said power switching means places said logging means in an active state when said sensing means senses that said logging means is not inside a restricted-inside-diameter portion of the drill hole while said logging means is in the armed state, wherein in the active state said power switching means selectively applies electrical power to said logging means such that said logging means is logging the density log of the installed material.

24. The apparatus of claim 23 wherein said power switching means places said logging means in a conditional reset state when said sensing means senses that said logging means is inside a restricted-inside-diameter portion of the drill hole for at least a second preselected interval of time while said logging means is in the active state, wherein in the conditional reset state said power switching means selectively applies electrical power to said logging means such that said logging means is not logging the density log of the installed material, but retains any density log of the installed material previously logged.

25. The apparatus of claim 24 wherein said power switching means places said logging means in the active state when said sensing means senses that said logging means is not inside a restricted-inside-diameter portion of the drill hole within less than a third preselected interval of time after said logging means enters the conditional reset state and said power switching means places said logging means in a reset state when said sensing means senses that said logging device is inside a restricted-inside-diameter portion of the drill hole continuously for at least the third preselected interval of time after said logging means enters the conditional reset state, wherein in the reset state said power switching means selectively applies electrical power to said logging means such that said logging means is not logging the density log of the installed material and does not retain any density log of the installed material previously logged.

26. The apparatus of claim 25 wherein said power switching means places said logging means in the active state when said sensing means senses that said logging means is not inside a restricted-inside-diameter portion of the drill hole while said logging means is in the reset state.

* * * * *